US008523015B2

(12) United States Patent
Eijkelkamp et al.

(10) Patent No.: US 8,523,015 B2
(45) Date of Patent: Sep. 3, 2013

(54) RECIPROCATING PUMP WITH REDUCED NOISE LEVEL

(75) Inventors: Marcus Franciscus Eijkelkamp, Groningen (NL); Michiel Allan Aurelius Schallig, Drachten (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 11/579,838

(22) PCT Filed: May 11, 2005

(86) PCT No.: PCT/IB2005/051542

§ 371 (c)(1),
(2), (4) Date: Nov. 7, 2006

(87) PCT Pub. No.: WO2005/111419

PCT Pub. Date: Nov. 24, 2005

(65) Prior Publication Data

US 2008/0031747 A1 Feb. 7, 2008

(30) Foreign Application Priority Data

May 17, 2004 (EP) ..... 04102149

(51) Int. Cl.
*F04B 17/00* (2006.01)
*F04B 39/00* (2006.01)
*B65D 35/28* (2006.01)

(52) U.S. Cl.
USPC ..... 222/95; 222/333; 222/401; 417/312

(58) Field of Classification Search
USPC ..... 222/95, 333, 401; 417/321, 312, 417/441, 571
See application file for complete search history.

(56) References Cited

U.S. PATENT DOCUMENTS

| | | | | |
|---|---|---|---|---|
| 3,310,230 | A * | 3/1967 | Wirth | 417/321 |
| 4,523,663 | A * | 6/1985 | Bar | 181/224 |
| 4,534,710 | A * | 8/1985 | Higuchi et al. | 417/269 |
| 5,238,370 | A | 8/1993 | DiFlora | |
| 6,454,131 | B1 | 9/2002 | Van Der Meer et al. | |
| 6,540,490 | B1 * | 4/2003 | Lilie | 417/416 |

(Continued)

FOREIGN PATENT DOCUMENTS

| | | |
|---|---|---|
| EP | 0737483 A1 | 10/1996 |
| EP | 1213258 A2 | 6/2002 |

(Continued)

OTHER PUBLICATIONS

Machine Translation of JP 2001—12349.*

*Primary Examiner* — Kenneth Bomberg

(57) ABSTRACT

The present invention is directed to a reciprocating motor pump (1) suitable to generate compressed gas with a reduced noise level of at most 55 dB, wherein said pump (1) includes a pump casing comprising:—a gas inlet nozzle (3);—a gas chamber;—a cylinder chamber (4) comprising a piston (5);—an inlet valve (7);—an outlet valve (8); and—a gas outlet port (9); wherein gas enters the gas chamber (2) through a gas inlet nozzle—(3) of said gas chamber (2) and then flows from said gas chamber (2) to said cylinder chamber (2) to said cylinder chamber (4) through an inlet valve (7) of said cylinder chamber (4), whereby the ratio of the diameter of the opening of the gas passage of said inlet nozzle (3) to the diameter of the opening of the gas passage of said inlet valve (7) is 1:15 to 1:5.

22 Claims, 3 Drawing Sheets

(56) References Cited

U.S. PATENT DOCUMENTS

| | | | | |
|---|---|---|---|---|
| 2001/0026762 | A1 | 10/2001 | Fujita et al. | |
| 2004/0009077 | A1* | 1/2004 | Seo | 417/312 |
| 2004/0151594 | A1* | 8/2004 | Allington et al. | 417/12 |
| 2006/0045770 | A1* | 3/2006 | Chuang | 417/416 |
| 2006/0120898 | A1* | 6/2006 | Zeh | 417/416 |

FOREIGN PATENT DOCUMENTS

| | | | | |
|---|---|---|---|---|
| EP | 1270943 | A2 | | 1/2003 |
| GB | 2186640 | A | | 8/1987 |
| JP | 57206784 | A | | 12/1982 |
| JP | 62028763 | A | | 2/1987 |
| JP | 05149254 | A | | 6/1993 |
| JP | 10068382 | A | | 3/1998 |
| JP | 100081397 | A | | 3/1998 |
| JP | 2001 012349 | | | 1/2001 |
| JP | 2001012349 | A | * | 1/2001 |
| WO | 03050031 | A1 | | 6/2003 |
| WO | WO03095835 | A1 | | 11/2003 |

* cited by examiner

RECIPROCATING PUMP WITH REDUCED NOISE LEVEL

The present invention relates to a reciprocating motor pump with a reduced noise level as well as to the use thereof. Furthermore, the present invention is directed to a beverage dispenser comprising said reciprocating motor pump with a reduced noise level.

Reciprocating pumps are common in prior art and are used in a variety of applications. However, reciprocating pumps suffer from the fact that during operation the gas suction noise level becomes too high.

It is disclosed in JP-A-2001012349 that the noise level from 63.0 dB to 57.0 dB of a reciprocating pump caused by the fluid passing sound of an inlet port and/or discharge port can be reduced by the regulation of the port diameter of the inlet port and/or the discharge port, wherein a silent plug is installed in the inlet port and the inlet port is part of the cylinder chamber.

The object of the present invention is to provide a reciprocating pump with an improved reduction of the noise level during operation.

This object is achieved by providing a reciprocating motor pump suitable to generate compressed gas with a reduced noise level of at most 55 dB, wherein said pump includes a pump casing comprising:

a gas inlet nozzle;
a gas chamber;
a cylinder chamber comprising a piston;
an inlet valve;
an outlet valve; and
a gas outlet port;

wherein gas enters the gas chamber through a gas inlet nozzle of said gas chamber and then flows from said gas chamber to said cylinder chamber through an inlet valve of said cylinder chamber, whereby the ratio of the diameter of the opening of the gas passage of said inlet nozzle to the diameter of the opening of the gas passage of said inlet valve is 1:15 to 1:5.

It has been found that the noise level of the incoming gas, which enters the gas chamber through a gas inlet nozzle having a much smaller diameter than the inlet valve of a cylinder chamber, wherein the gas flows from the gas chamber into the cylinder chamber, can be significantly reduced.

The noise level of a reciprocating motor pump according to the present invention is at most 55 dB. However, depending on the ratio of the diameter of the opening of the gas passage of said inlet nozzle to the diameter of the opening of the gas passage of said inlet valve, the noise level of the pump can be reduced to a noise level of 1 dB to 50 dB, preferred 2 dB to 40 dB, more preferred 3 dB to 30 dB, further preferred 4 dB to 20 dB and also preferred 5 dB to 10 dB. Most preferred is a noise level of 4 dB to 5 dB for a reciprocating motor pump according to the present invention. However, the noise level of a reciprocating motor pump according to the present invention can be from 38 dB to 18 dB, 36 dB to 22 dB, 34 dB to 24 dB, 32 dB to 26 dB or about 28 dB.

It has been found that a continuous gas flow from the gas chamber to the inner stroke volume of the cylinder chamber comprising the piston can be obtained if the gas chamber is bigger than the cylinder chamber comprising the piston. Thus, it can be advantageous if the inner volume of the gas chamber is at least 3 times larger than the maximum gas stroke volume of the cylinder chamber comprising the piston.

According to the present invention the inner volume of the gas chamber can be at least 3 times, preferably 5 to 10 times larger than the maximum gas stroke volume of the cylinder chamber comprising the piston.

Due to the larger volume of the gas chamber the gas can continuously flow from the outside into the gas chamber. From the gas chamber, the cylinder chamber can easily be filled. Furthermore, the gas volume drawn into the cylinder chamber can easily be replaced between two strokes due to the much larger volume of the gas chamber compared to the maximum stroke volume of the cylinder chamber.

The larger volume of the gas chamber allows the gas inlet nozzle through which gas enters the gas chamber to be much smaller than the opening of the gas passage of said inlet valve of the cylinder chamber. Although the opening of the gas inlet nozzle has a small diameter, gas can easily flow through said opening without increasing the noise level of the reciprocating motor pump up to the desired value of at most 55 dB.

The ratio of the diameter of the opening of the gas passage of said inlet nozzle to the diameter of the opening of the gas passage of said inlet valve is 1:15 to 1:5, preferred 1:12 to 1:7 and more preferred 1:10 to 1:9.

Without being bond to a certain theory, it is believed that the specific ratio of the two said openings, i.e. inlet nozzle and inlet valve, dramatically reduces the frequency of the sound of the gas passage.

However, the gas passage sound and thus the noise level of a reciprocating motor pump according to the present invention can additionally be lowered if the inner volume of the gas chamber is larger than the maximum gas stroke volume of the cylinder chamber comprising the piston as mentioned above.

The reciprocating motor pump according to the present invention is discussed below in more detail.

The pump material can be a metal and/or polymeric material, preferably a polyoxymethylene (POM), except for parts subjected to high temperatures, which should be made of a thermo stable polymer, such as polyphenylene (PPS).

It is preferred that the part of the piston that rubs against the inner cylinder wall of the cylinder chamber is made of polytetrafluorethylene (PTFE).

Further, it is preferred that the valves are based on a rubberlike material, such as acrylnitrile-butadiene-rubber (NBR).

However, any material that is suitable can be used to make the reciprocating motor pump according to the present invention.

All kinds of suitable motors having a low noise level can be used, while a DC motor is preferred.

It is preferred that the diameter of the opening of said gas inlet nozzle, preferably the diameter of the opening of the gas passage at the outer surface of said gas inlet nozzle, is 0.1 mm to 3 mm, preferably 0.5 mm and 1.5 mm and more preferred 1.0 mm to 1.2 mm; and/or the diameter of the opening of the gas passage of said inlet valve is 1 mm to 10 mm, preferably 2 mm and 5 mm and more preferred 3.5 mm to 4 mm; and/or the diameter of the gas outlet port is 1 mm to 10 mm, preferably 2 mm and 5 mm and more preferred 3.5 mm to 4 mm.

The gas inlet nozzle preferably has a passage length of 0.5 mm to 10 mm, preferably 1 mm and 8 mm and more preferred 3 mm to 4 mm; and/or said inlet valve has a passage length of 0.5 mm to 10 mm, preferably of 1 mm and 5 mm and more preferred of 3 mm to 4 mm.

The gas chamber can have an inner gas volume of 4000 $mm^3$ to 20000 $mm^3$, preferably of 6000 $mm^3$ and 10000 $mm^3$, more preferred of 7000 $mm^3$ to 8000 $mm^3$ and most preferred of 7500 $mm^3$ to 7800 $mm^3$.

The maximum stroke volume of the cylinder camber can have a inner gas volume of 1000 $mm^3$ to 4000 $mm^3$, preferably of 1500 $mm^3$ and 3000 $mm^3$, more preferred of 2000 $mm^3$ to 2500 $mm^3$ and most preferred of 2200 $mm^3$ to 2300 $mm^3$.

A reciprocating motor pump according to the present invention can preferably be designed in such a manner that the gas flows through said gas inlet valve and/or said gas outlet port at a gas flow rate of 1 l/min to 10 l/min, preferably 2 l/min to 5 l/min and more preferred 3 l/min to 4 l/min.

The gas can be an inert gas, preferably the gas is air, nitrogen and/or carbon dioxide and most preferred the gas is air.

A reciprocating motor pump according to the present invention can have a gas chamber with a gas inlet nozzle through which gas from the atmosphere can be directly sucked in.

It is preferred that a cylinder chamber comprising a piston is arranged adjacent to the gas chamber, wherein the gas chamber and the cylinder chamber form a common wall section and an inlet valve is arranged in said common wall section so that gas can flow from the gas chamber directly into the inner stroke volume of the cylinder chamber comprising the piston.

It is further preferred that the cylinder chamber has at least one outlet valve with a gas outlet port, so that compressed gas can exit the pump casing from the inner stroke volume of the cylinder chamber through the outlet valve of the outlet port.

The outlet valve of the outlet port is preferably situated on a wall section of the cylinder chamber. It is preferred that at least one inlet valve is situated at an inlet port and at least one outlet valve is situated at an outlet port, whereby both valve assemblies are arranged on the same wall section of the cylinder chamber.

At the time of a charging piston stroke the negative pressure inside the cylinder chamber leads to an opening of the inlet vale, for example situated at a common wall section of the gas chamber and the cylinder chamber, so that gas flows from the gas chamber into the forming stroke volume of said cylinder chamber. At the time of a compressing piston stroke the overpressure causes an opening of the outlet valve of the outlet port situated at the cylinder chamber, so that compressed gas exits the pump casing through the outlet port.

A reciprocating pump according to the present invention is actuated by a motor, wherein the drive shaft of the motor is coaxially connected to a crankshaft to drive a piston rod connected to the piston, wherein the crankshaft with a counterbalance transfers the rotary motion to the piston rod of the piston. A bearing can optionally be arranged between the piston rod and the piston.

Further, a reciprocating pump according to the present invention can comprise a bearing between the piston rod and the crankshaft and the motorshaft is connected to an excenter. There is a bearing around the excenter and in the piston rod there is a large hole in which the bearing fits.

The compressed gas of the inner stroke volume in the cylinder chamber and/or the compressed gas which exits the gas outlet port can have an overpressure of at least 0.5 bar, preferably 1 to 2 bars and more preferably 1.5 bar.

The piston stroke of a reciprocating pump according to the present invention can be 2 mm to 10 mm, preferably 3 mm to 9 mm and more preferably 5 mm to 7 mm.

A preferred embodiment of a reciprocating pump according to the present invention comprises a gas chamber with a gas inlet nozzle arranged adjacent to the cylinder chamber comprising a piston, wherein the gas chamber and the cylinder chamber form a common wall section, the inlet valve is arranged in said common wall section and at least one outlet valve with a gas outlet port is connected to the cylinder chamber so that compressed gas can flow through, wherein the drive shaft of the motor is coaxially connected to a crankshaft to drive a piston rod connected to the piston, wherein the crankshaft with a counterbalance transfers the rotary motion over a bearing to the piston rod of the piston. A bearing can optionally be arranged between the piston rod and the piston.

A reciprocating motor pump with a reduced noise level according to the present invention can be used in connection with and/or integrated in an apparatus to deliver gas under pressure with a reduced noise level, where the apparatus is preferably a domestic appliance and/or a medical device.

Most preferred is a beverage dispenser comprising a reciprocating motor pump with a reduced noise level according to the present invention.

Beverages which can be used are preferably non-carbonated beverages or $CO_2$-containing beverages and most preferably beer. However, it is obvious to a person skilled in the art that all kinds of fluids, such as liquids, can be used. Thus, in the meaning of the present invention, the term beverage includes all kinds of liquids.

The gas pressure produced by the reciprocating motor pump according to the present invention can be used to deliver beverages of a beverage dispenser, whereby the gas pressure produced by the reciprocating motor pump is used to deliver beverages, preferably $CO_2$-containing beverages, from a beverage container and/or is used for dispensing the $CO_2$-containing beverage from a container upon deformation of a flexible wall part by the gas pressure out of a beverage container and/or is used for dispensing the $CO_2$-containing beverage from a container upon deformation of a flexible wall part by the gas pressure.

Using the gas pressure produced by the reciprocating motor pump according to the present invention for dispensing the $CO_2$-containing beverage from a container upon deformation of a flexible wall part by the gas pressure has the advantage that the gas does not contaminate the beverage.

A reciprocating motor pump according to the present invention can be used as a pressure means for a beverage dispenser comprising a beverage container having a deformable wall part as disclosed in EP-A2 1 213 258, WO 03/050031 as well as in US B1U.S. Pat. No. 6,454,131, and incorporated herein by reference.

A further preferred embodiment of the present invention is a beverage dispensing assembly with a reciprocating motor pump as a pressure means, comprising an outer housing having a tapping device, and a container being placeable inside the outer housing, the container comprising a $CO_2$-containing beverage and having a deformable wall part which is compressible by the pressure means, an outlet and a flexible tube connectable to the outlet for dispensing a beverage such as beer from the container upon deformation of the flexible wall part by the pressure means.

Still another preferred embodiment of the present invention is a beverage dispensing assembly with a reciprocating motor pump as a pressure means, comprising a container in which an inner bag is provided for receiving a beverage, in particular carbonated beverages such as beer, wherein the gas, preferably air, is discharged under pressure between an inner surface of said container wall and the outer surface of said inner bag, so that the beverage such as beer is dispensed upon deformation of the flexible wall part by the pressure means.

The reciprocating motor pump according to the present invention is further illustrated by drawings in which.

Figure 1:
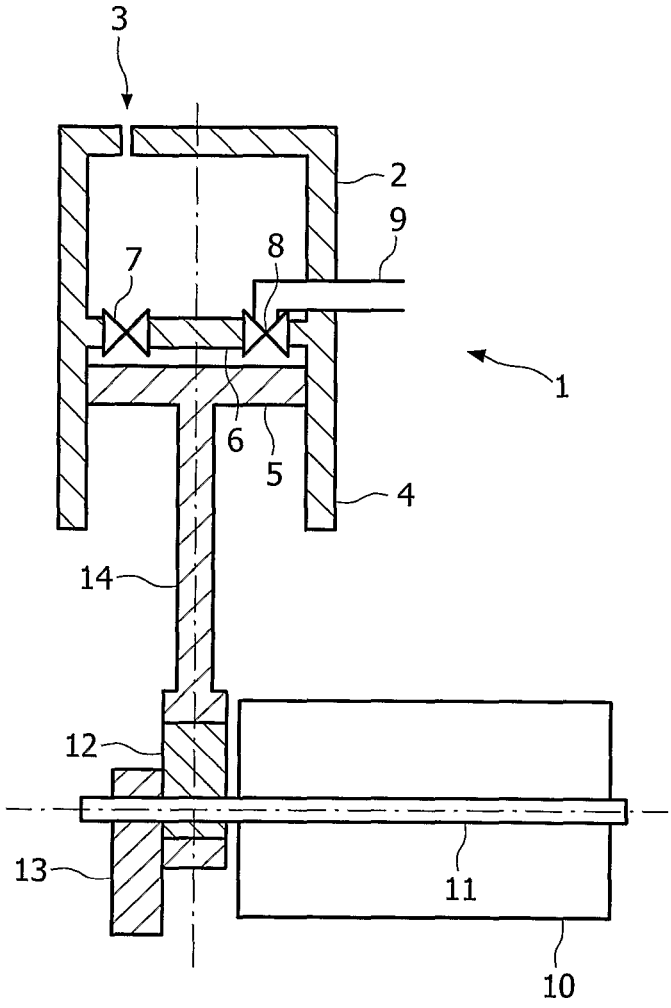
FIG. 1 is a cross section of a reciprocating motor pump according to the present invention, whereby the piston is in top position.

FIG. 1 shows a cross section of reciprocating motor pump (1), comprising a gas chamber (2) with a gas inlet nozzle (3), having a gas passage opening of a specified diameter, and an inner volume of 7800 mm3, whereby the gas chamber (2) is arranged adjacent to the cylinder chamber (4) with a maximum stroke volume of 2260 mm3 and comprising a piston (5) in top position (compressing stage), whereby the gas chamber (2) and the cylinder chamber (4) form a pump casing. The gas chamber (2) and the cylinder chamber (4) have a common wall section (6). An inlet valve (7), having a gas passage opening of a specified diameter, is arranged in a port of said common wall section (6) and an outlet valve (8) with a gas outlet port (9) is connected to the cylinder chamber (4) so that gas under pressure can flow through to exit the pump (1), whereby the drive shaft (11) of the DC motor (10) is coaxially connected to a crankshaft (12) to drive a piston rod (14) connected to the piston (5), whereby the crankshaft (12) with a counterbalance (13) transmit the rotary motion over a bearing (not shown in FIG. 1) to the piston rod (14) of the piston (5).

Figure 2:
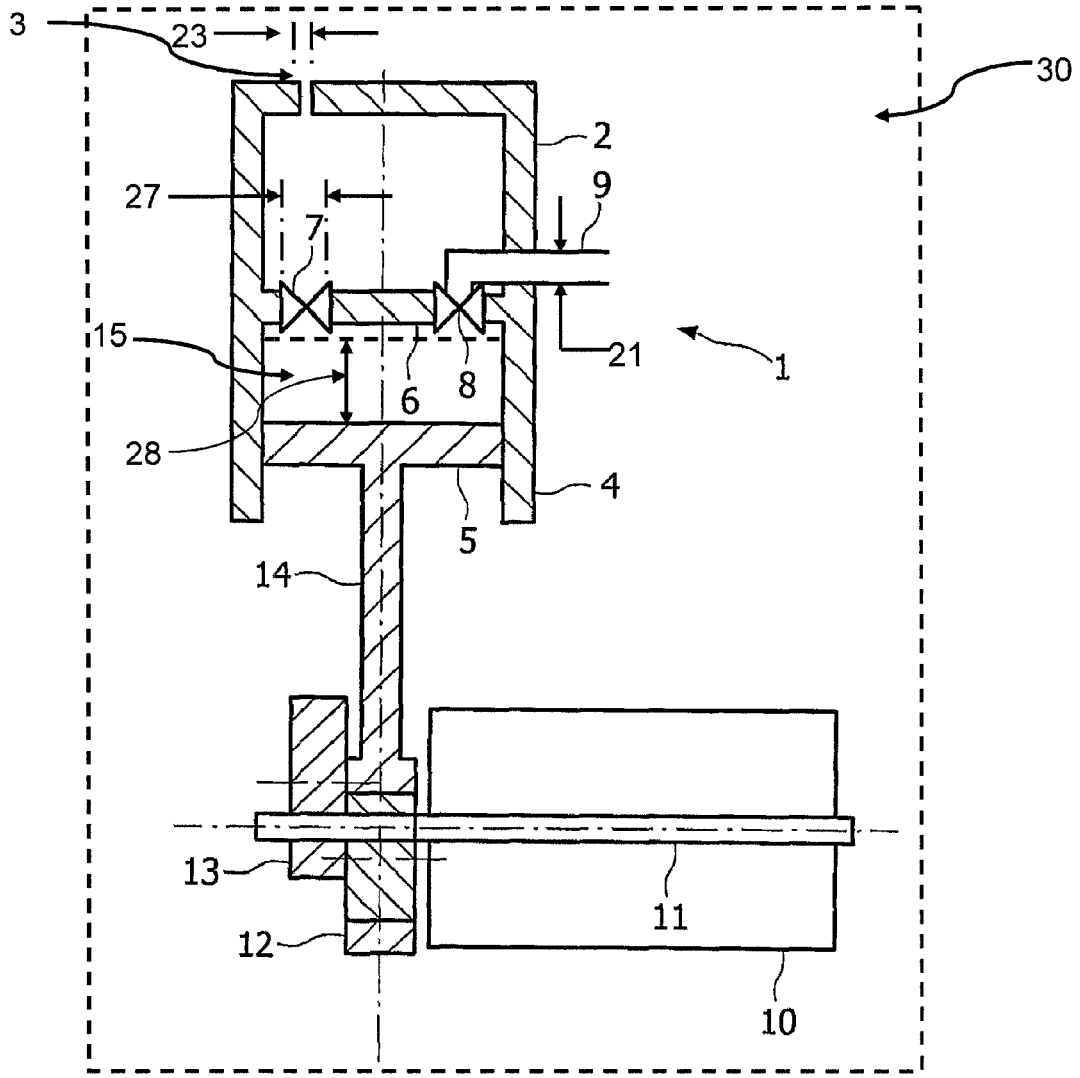
FIG. 2 is a cross section of a reciprocating motor pump according to the present invention, whereby the piston is in lower position.

FIG. 2 shows a cross section of an apparatus 30, such as a beverage dispenser, a domestic appliance and/or a medical device including reciprocating motor pump (1), comprising a gas chamber (2) with a gas inlet nozzle (3), having a gas passage opening of a specified diameter (23), and an inner volume of 7800 $mm^3$, whereby the gas chamber (2) is arranged adjacent to the cylinder chamber (4) with a maximum stroke volume of 2260 $mm^3$ and comprising a piston (5) having a piston stroke 28 shown in a maximum downward position (suction stage), which gives a maximum inner stroke volume (15). The gas chamber (2) and the cylinder chamber (4) form a pump casing. Furthermore, the gas chamber (2) and the cylinder chamber (4) have a common wall section (6). An inlet valve (7), having a gas passage opening of a specified diameter (27), is arranged in a port of said common wall section (6) and an outlet valve (8) with a gas outlet port (9) having a gas outlet port diameter 21 is connected to the cylinder chamber (4) so that gas under pressure can flow through to exit the pump (1), whereby the drive shaft (11) of the DC motor (10) is coaxially connected to a crankshaft (12) with a counterbalance (13) to drive a piston rod (14) connected to the piston (5), whereby the crankshaft (12) transmit the rotary motion over a bearing (not shown in FIG. 2) to the piston rod (14) of the piston (5).

Figure 3:
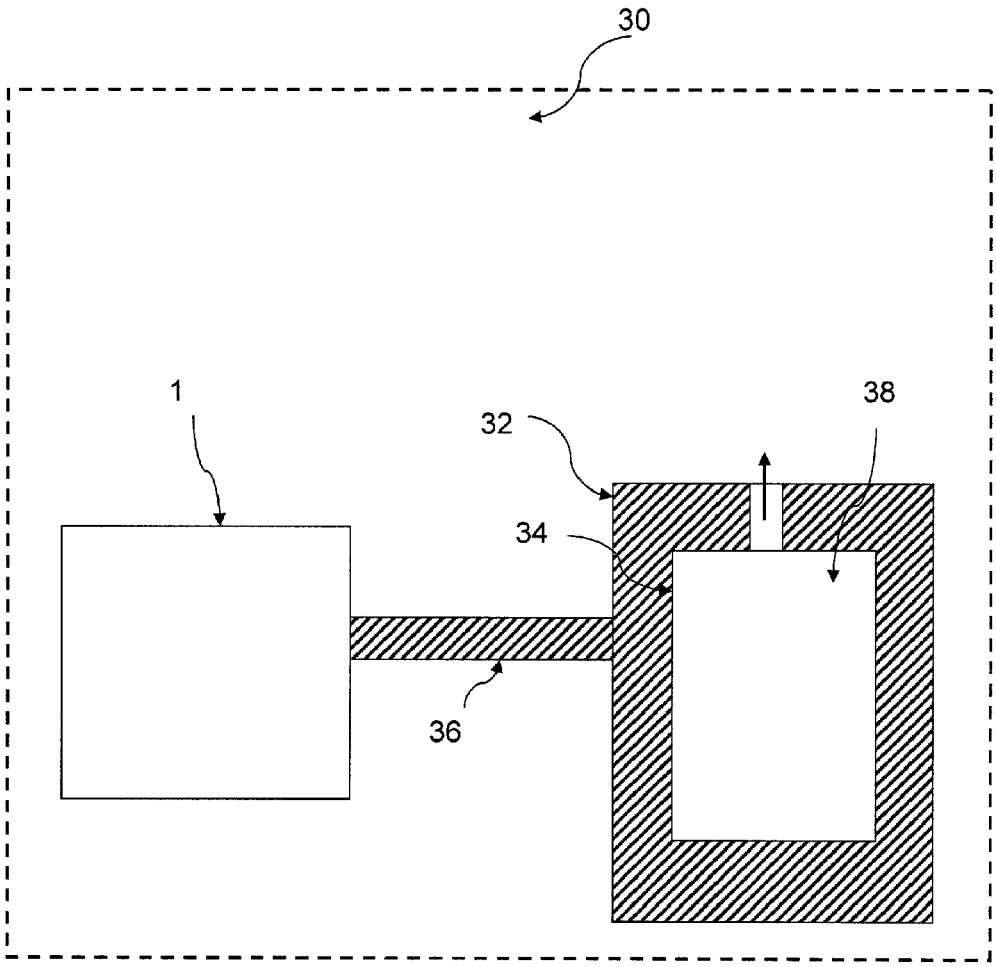
FIG. 3 is a reciprocating motor pump according to the present invention that may be used as a portion of an apparatus to deliver beverages.

FIG. 3 shows a reciprocating motor pump 1 according to the present system that may be used as a portion of an apparatus 30, such as a beverage dispenser, to deliver beverages. Gas pressure 36 produced by the reciprocating motor pump 1 is shown used for dispensing a CO2-containing beverage 38 from a container 32 upon deformation of a flexible wall part 34 by the gas pressure 36. Using the gas pressure 36 produced by the reciprocating motor pump 1 according to the present invention for dispensing the CO2-containing beverage 38 from the container 34 upon deformation of the flexible wall part 34 by the gas pressure 36 has the advantage that gas used to generate the gas pressure 36 does not contaminate the beverage 38.

The invention claimed:

1. A reciprocating motor pump suitable to generate compressed gas with a reduced noise level, said pump includes a pump casing comprising:

a wall;

a gas chamber formed above the wall;

a cylinder chamber formed below the wall and comprising a piston, an inner volume of the gas chamber being larger than a maximum stroke volume of the cylinder chamber; an inlet valve and an outlet valve formed in the wall;

a gas inlet nozzle positioned in the gas chamber; and a gas outlet port positioned in the gas chamber and coupled to the outlet valve, gas enters the gas chamber through the gas inlet nozzle and then flows from said gas chamber to said cylinder chamber through the inlet valve, the ratio of a diameter of an opening of a gas passage of said inlet nozzle to a diameter of an opening of gas passage of said inlet valve is in the range of 1:15 to 1:5 and the noise level generated by the motor pump is at most 55 dB.

2. The pump of claim 1, wherein at least one of the diameter of the opening of said gas passage of said inlet nozzle is between 0.1 mm to 3 mm, the diameter of the opening of the gas passage of said inlet valve is between 1 mm to 10 mm, and a diameter of the gas outlet port is between 1 mm to 10 mm.

3. The pump of claim 1, wherein gas passes through said inlet valve and/or said gas outlet port at a gas flow rate of 1 l/min to 10 l/min.

4. The pump according to claim 1, wherein the inner volume of the gas chamber is at least 3 times larger than the maximum stroke volume of the cylinder chamber.

5. The pump according to claim 1, wherein a piston stroke of the piston is between 2 mm to 10 mm.

6. The pump according to claim 1, wherein at least one of the compressed gas of a piston stroke of the piston in the cylinder chamber and the compressed gas which exits the gas outlet port has an overpressure of at least 0.5 bar, wherein the overpressure causes opening of the outlet valve.

7. The pump according to claim 1, wherein a drive shaft of a motor is coaxially connected to a crankshaft to drive a piston rod connected to the piston, the crankshaft with a counterbalance transfers its rotary motion over a bearing to the piston rod of the piston.

8. The pump according to claim 1, wherein the piston stroke is 3 mm to 9 mm.

9. The pump according to claim 1, wherein the piston stroke is 5 mm to 7 mm.

10. The reciprocating motor pump according to claim 1, comprising one of an appliance and a medical device, the reciprocating motor pump delivering gas under pressure with a reduced noise level to the one of the appliance and the medical device.

11. The pump of claim 1, wherein the diameter of the opening of said gas passage of said gas inlet nozzle is between 0.5 mm and 1.5 mm.

12. The pump of claim 1, wherein the diameter of the opening of said gas passage of said gas inlet nozzle is between 1.0 mm to 1.2 mm.

13. The pump of claim 1, wherein the diameter of the opening of the gas passage of said inlet valve is between 2 mm and 5 mm.

14. The pump of claim 1, wherein the diameter of the opening of the gas passage of said inlet valve is between 3.5 mm to 4 mm.

15. The pump of claim 1, wherein the diameter of the gas outlet port is between 2 mm and 5 mm.

16. The pump of claim 1, wherein the diameter of the gas outlet port is between 3.5 mm to 4 mm.

17. The pump of claim 1, wherein gas flows through at least one of said gas inlet valve and said gas outlet port at a gas flow rate of between 2 l/min to 5 l/min.

18. The pump of claim 1, wherein gas flows through at least one of said gas inlet valve and said gas outlet port at a gas flow rate of between 3 l/min to 4 l/min.

19. The pump according to claim 1, wherein the inner volume of the gas chamber is at least 3 times larger than the maximum stroke volume of the cylinder chamber.

20. The pump according to claim 1, wherein at least one of the compressed gas of a piston stroke of the piston in the cylinder chamber and the compressed gas which exits the gas outlet port has an overpressure of at least 1 bar, and the overpressure opens the outlet valve.

21. A beverage dispenser including a reciprocating motor pump for generating compressed gas with a reduced noise level, the pump includes a casing comprising:

a wall forming gas and cylinder chambers, with an inner volume of the gas chamber being at least three times larger than a maximum stroke volume of the cylinder chamber;

an inlet valve and an outlet valve formed in the wall;

the gas chamber receiving gas which flows to the cylinder chamber through the inlet valve;

a gas inlet nozzle formed in the wall of the gas chamber, a ratio of diameters of gas passage openings of the gas inlet nozzle and the inlet valve is in the range of 1:15 to 1:5; and a gas outlet port positioned in the gas chamber, the gas outlet port is connected to the outlet valve, the gas leaves the cylinder chamber and flows out through the gas outlet valve and the gas outlet port, and the noise level generated by the beverage dispenser is at most 55 dB.

22. The dispenser according to claim 21, comprising a beverage container having a flexible wall part, the beverage container containing a beverage including $CO_2$, the beverage container dispenses the beverages upon deformation of the flexible wall part by gas pressure produced by the reciprocating motor pump.

* * * * *